US005483225A

United States Patent [19]

Hwang

[11] Patent Number: 5,483,225

[45] Date of Patent: Jan. 9, 1996

[54] STRUCTURE OF A SHOCK DEVICE OF A SHOCK SENSOR OF A BURGLAR ALARM

[76] Inventor: Shih-Ming Hwang, 17811 Sky Park Cir., Suite D & E, Irvine, Calif. 92714

[21] Appl. No.: 377,941

[22] Filed: Jan. 25, 1995

[51] Int. Cl.[6] ..... G08B 13/02

[52] U.S. Cl. ..... 340/566; 73/649; 73/651; 340/429; 340/683

[58] Field of Search ..... 340/566, 429, 340/683; 381/176, 177; 73/651, 649

[56] References Cited

U.S. PATENT DOCUMENTS 4,028,567 6/1977 Maillot ..... 340/566
4,234,876 11/1980 Murai ..... 340/566
4,247,847 1/1981 Gontowski, Jr. ..... 340/566
4,584,569 6/1990 Lopez et al. ..... 340/566

*Primary Examiner*—Glen Swann
*Attorney, Agent, or Firm*—Bacon & Thomas

[57] ABSTRACT

A shock sensor includes an inductance coil, a magnet, a magnetically soft material, and a support bracket for the magnetically soft material. The inductance coil and the magnet are fixed relative to each other. The magnetically soft material has one side thereof fixed on the support bracket and lies relative to the coil and the magnet so that the magnetically soft material can move up and down as well as leftwardly and rightwardly and inwardly and outwardly when the shock device vibrates and thereby alter a magnetic flux from the magnet to the inductance coil so as to generate signals responsive to the fluctuations of a magnetic flux.

7 Claims, 3 Drawing Sheets

STRUCTURE OF A SHOCK DEVICE OF A SHOCK SENSOR OF A BURGLAR ALARM

The present invention relates to an improved structure of a shock device of a shock sensor of a burglar alarm, particularly to a shock device including an inductance coil, a magnet, a magnetically soft material, and a support bracket for the magnetically soft material, in which the inductance coil and the magnet are stationary and are fixed on two positions respectively, with one position facing another position. The magnetically soft material is supported, at a space between the inductance coil and the magnet, by the support bracket for the magnetically soft material. The magnetically soft material can vibrate with the support bracket for the magnetically soft material in the space between the inductance coil and the magnet so as to alter the magnetic flux and generate inductance signals which are then sent to an amplifier and subsequent circuit for handling.

BACKGROUND OF THE INVENTION

Most of the shock devices of the shock sensors of the conventional burglar alarms adjust the sensitivity of the shock device through control circuits. In this kind of shock device of shock sensors of the burglar alarms, the control circuits can only be set to an optimum condition in a factory where they are produced. The control circuits tend to be inaccurate because of the moisture and dust encountering the control circuits after the circuits are produced. This requires readjustment for the control circuits after they have been used for a while. It is not easy for the users to do the readjustments for the control circuits and thus the performance of the burglar alarms become more and more unsatisfactory.

Recent conventional shock sensors utilize electronic control circuits, which are fixed after being produced, incorporating shock sensors which are highly controlled. It is not easy for the characteristics of the shock sensors to be influenced by external environment because the shock sensors are of mechanical structures. However, the mechanical shock sensors tend to suffer from irresistable changes of stress. Therefore, many manufacturers of burglar alarms try to improve shock sensors. The present invention improves a kind of popular conventional shock device of a shock sensor of a burglar alarm, which is shown in FIGS. 1 and 2. The conventional shock device includes mainly an "⊔" shaped enclosure 1. An inductance coil 11 is provided on the central lower portion of the enclosure 1. A resilient rubber element 12 having a cylindrical cup 121 at the center thereof is provided in the enclosure 1. A permanent magnet 122 is installed in the cylindrical cup 121, with the magnet 122 facing the inductance coil 11 in the enclosure 1. Cylindrical ends 123 and 124 are provided on two sides of the rubber element 12, respectively, for fixing the rubber element 12 on two fixing posts 13 and 14 in the enclosure 1. The rubber element 12 has two arms 125 and 126. The magnet 122 is of some distance from the fixing posts 13 and 14 and the arms 125 and 126 are resilient. Therefore, the magnet 122 can move up and down as well as leftwardly and rightwardly repeatedly when there is a shock to the shock device. However, this shock device suffers from the following drawbacks:

(1) The structural shape of the enclosure 1 of this conventional shock device is complicated and needs high stability. The elements such as the rubber element 12 and the inductance coil 11 must be installed in the enclosure 1 stably, symmetrically, and without any inclination. This makes the production and the assembling difficult.

(2) The enclosure 1 can not be deformed, even slightly, otherwise it would be difficult to be repaired. Besides, it is easy for defects in the device to occur during production because higher standards must be met for the enclosure 1 to function properly. Thus, it is difficult to do quality control.

(3) It is difficult to adjust and set the rubber element 12 to its proper position during assembly. Therefore, this is time consuming and the cost thereof is increased.

(4) In the conventional shock sensor, the magnet 122 on the rubber element 12 will be moved when there is a vibration caused to the shock sensor. Thus, signals will be generated on the inductance coil 11 in the enclosure 1 because there is an altering of magnetic flux by the magnet 122. However, after a period of use, the rubber element 12 will be aging and degrade rapidly. This causes an unsatisfactory product.

The present invention mitigates the drawbacks of the above-mentioned shock sensor and provides a more effective shock device of a shock sensor of a burglar alarm.

The present invention shall be described in detail with reference to the drawings. These descriptions are provided for better understanding of the present invention and should not be construed as limitations of the scope of the present invention.

DETAILED DESCRIPTION OF PREFERRED EMBODIMENTS

Figure 3:
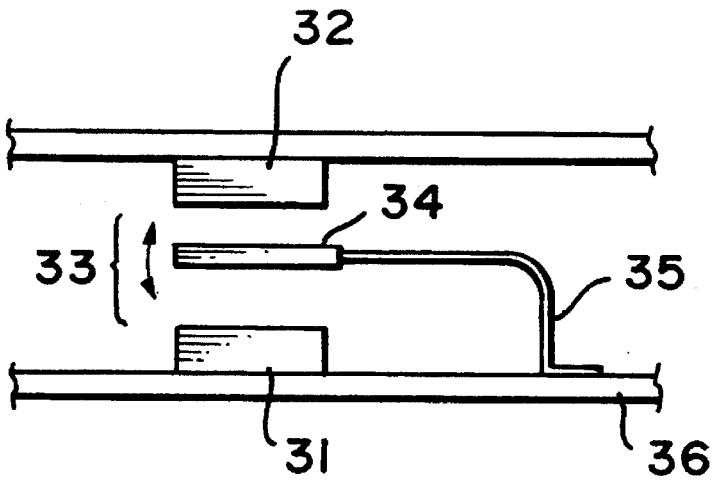
FIG. 3 is a side view of an embodiment of a shock device of a shock sensor of the burglar alarm of the present invention.
Figure 4:
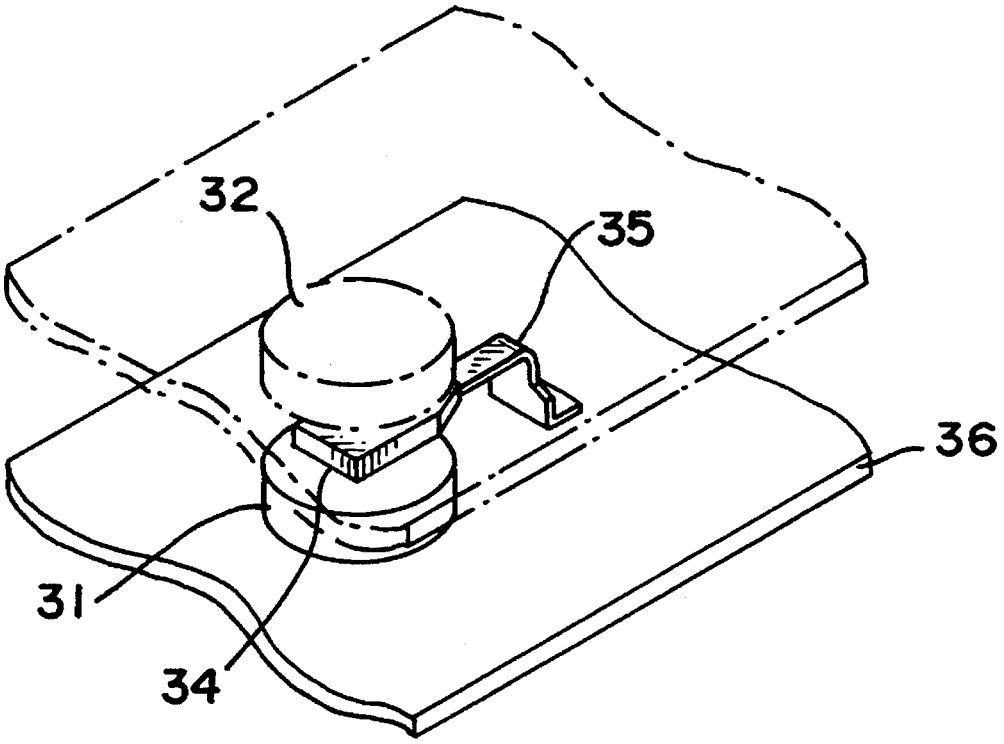
FIG. 4 is a perspective view of the shock device of a shock sensor of the burglar alarm of the present invention.

Please refer to FIGS. 3 and 4. The feature of the present invention resides in that the inductance coil 11 and the magnet 122 in the conventional shock device are changed to be an inductance coil 31 and a magnet 32 which are fixed on two positions respectively, with one position facing another position, and with a magnetically soft material 34 supported at a space 33 between the inductance coil 31 and the magnet 32. The magnetically soft material 34 is supported by a support bracket 35 which in turn is fastened to a fastening seat 36. A wall for fastening the magnet 32 and the seat 36 can be part of the shock sensor. The magnetically soft material 34 can be moved up and down as well as leftwardly and rightwardly when there is a vibration caused to the shock device, so as to alter the magnetic flux between the inductance coil 31 and the magnet 32 and generate signals showing the fluctuations of the magnetic flux. The signals are amplified and handled by subsequent control circuits not shown in the drawings. Those skilled in the art will appreciate that magnet 32 may be a permanent magnet or an electromagnet, that the inductance coil 31 can be any type of conventional inductance coil (including coils having air, ferrite, steel, or magnets as the center core), and that the inductance coil 31 can be positioned anywhere relative to the magnet so long as an electric potential is induced by a changing magnetic flux in the inductance coil, the electric potential generating a signal responsive to changes in the magnetic field caused by movement of magnetically soft material 34.

The support bracket 35 for the magnetically soft material can be an iron sheet, a steel sheet, a rubber sheet, a spring, a fiber, an empty closed chamber 35', (shown in FIG. 5A) for enclosing the magnetically soft material 34' while holding it in position between the inductance coil 31 and the magnet 32, or a closed chamber 35' filled with oil (the oil set as a damper to stabilize flux vibrational motion of the magnetically soft material 34'), serving as a resilient support for the magnetically soft material 34 or 34'. The magnetically soft material 34 can be of different shapes (e.g., 34' as shown in FIG. 5A) or materials, which can alter the magnetic flux between the inductance coil 31 and the magnet 32 and generate signals showing the fluctuations of the magnetic flux via the inductance coil 31.

Figure 1:
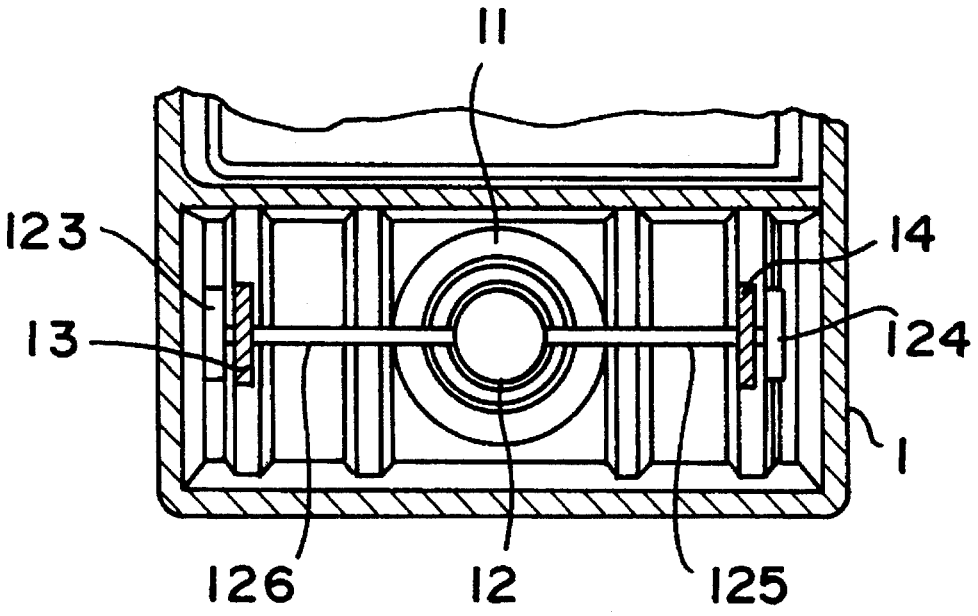
FIG. 1 (PRIOR ART)
FIG. 1 is a top view of a shock device of shock sensor of a conventional burglar alarm.
Figure 2:
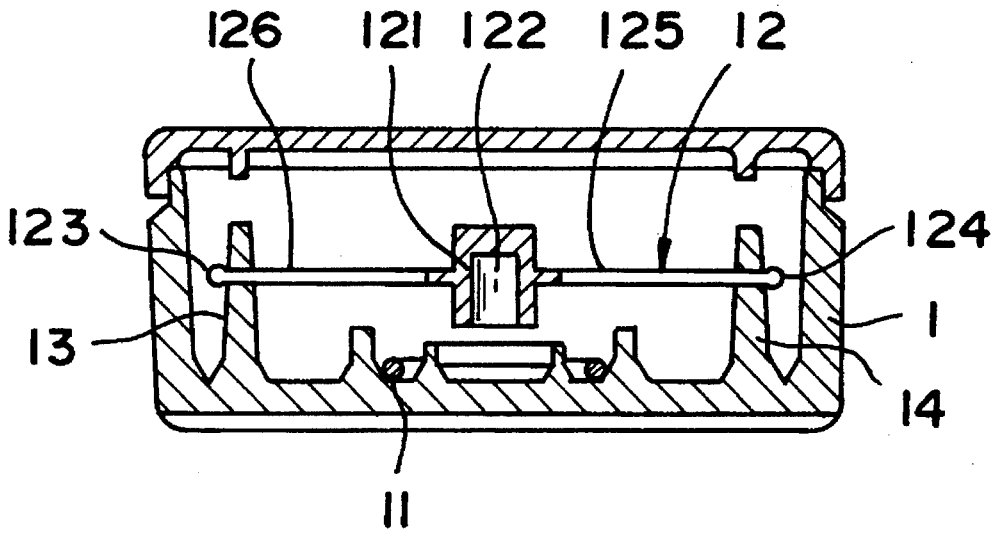
FIG. 2 (PRIOR ART)
FIG. 2 is a side view of a shock device of shock sensor of a conventional burglar alarm.
Figure 5:
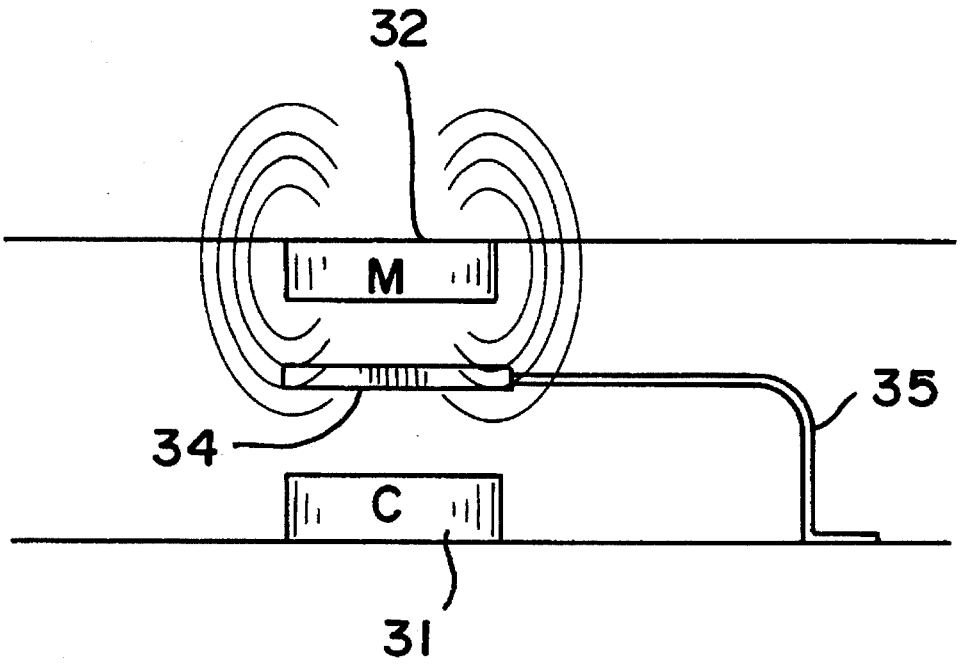
FIG. 5 depicts the flux lines of the shock device of a shock sensor of the burglar alarm of the present invention.
Figure 5A:
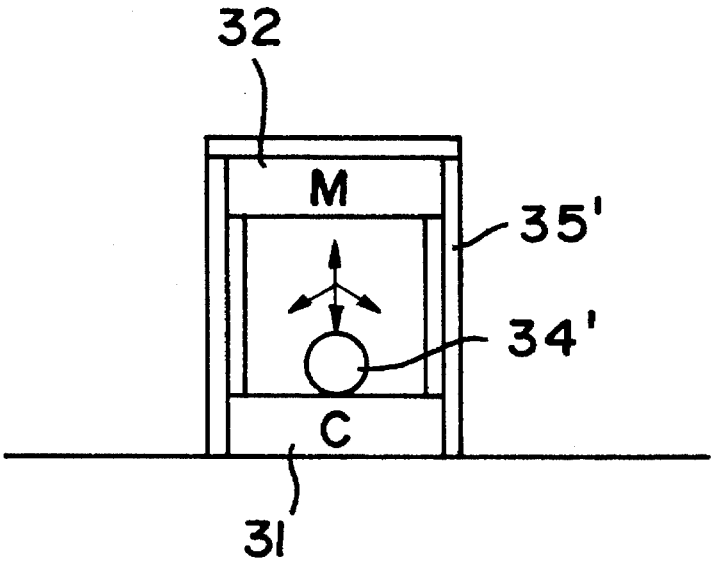
FIG. 5A shows another embodiment of the present invention depicting a different arrangement.

Please refer to FIG. 5. The characteristics of the present invention is that the magnetically soft material 34 is provided between the stationary inductance coil 31 and the magnet 32. The magnetically soft material 34 can move to different directions such as upward, downward, leftward, and rightward and alter the magnetic flux between the inductance coil 31 and the magnet 32 so as to cause fluctuations (oscillating) of the magnetic flux and generate signals to be handled by subsequent circuits. On the contrary, in the conventional device shown in FIGS. 1 and 2, the magnet 122 is supported on resilient arms 125 and 126 which make the magnet 122 difficult to move freely. Furthermore, the arms 125 and 126 tend to lose resiliency after a period of time. This makes the moving of the magnet 122 unreliable. Besides, there is no magnetic shielding between the inductance coil 11 and the magnet 122. There some error will occur in the circuit because there may be some magnetic saturation incurred and the vibration (shock) sensing effect will be affected.

The advantages of the shock device of the shock sensor of the present invention over the conventional ones are that:

(1) The required stability of the present invention can be easily achieved by controlling the length, thickness, and material of the support bracket 35 of the magnetically soft material. Thus, it is easy to produce and assemble the products.

(2) The shock device of the present invention can be used on a relatively unstable position.

(3) The products of the present invention need no adjustment for positioning the elements thereof, after they are assembled in the factory, because signals are generated from the altering of the magnetic flux between the inductance coil 31 and magnet 32 by the magnetically soft material 34. The signals can be generated as long as the magnetically soft material 34 can be kept in the magnetic field.

(4) There are no aging or degrading problems, occurred to the conventional shock device, in the products of the present invention. The products of the present invention can last for a long period of time and there will be very few unacceptable products after they are produced.

I claim:

1. A shock device for a shock sensor for a burglar alarm, including inductance coil means in which an oscillating electric potential is induced in response to a changing magnetic flux for generating an electric signal, magnet means for generating a magnetic field, a magnetically soft material, and a support means for the magnetically soft material, wherein the magnetically soft material is independently fixed to the support means and mounted such that it penetrates the magnetic field generated by the magnet means, so that when vibrations cause the magnetically soft material to move to and fro relative to the inductance coil means and the magnet means and alter the magnetic flux, a corresponding oscillating electric potential is induced in the inductance coil means and an electric signal responsive to movement of the soft magnetic material is thereby generated in the inductance means.

2. A device as claimed in claim 1, in which the support means for the magnetically soft material is made of a resilient material having a capability of supporting the magnetically soft material.

3. A device as claimed in claim 1, in which the support means for the magnetically soft material is an empty closed chamber enclosing the magnetically soft material while holding it in position between the inductance coil means and the magnet means.

4. A device as claimed in claim 3, in which the closed chamber is filled with oil, which acts as a damper to stabilize vibrational motion of the magnetically soft material.

5. A device as claimed in claim 1, in which the magnetically soft material is of a material capable of altering the magnetic flux and thereby generating signals via the inductance coil means.

6. A device as claimed in claim 1, in which the magnet means is a permanent magnet.

7. A device as claimed in claim 1, in which the magnet means is an electromagnet.

* * * * *